United States Patent [19]

Kiefer

[11] 4,107,755

[45] Aug. 15, 1978

[54] STATIC ELIMINATOR AND ION DISCHARGE MEANS THEREFOR

[76] Inventor: Richard J. Kiefer, 72 Fulton Ave., Garden City, N.Y. 11530

[21] Appl. No.: 760,083

[22] Filed: Jan. 17, 1977

[51] Int. Cl.[2] ..... H01T 19/04; H05F 3/00

[52] U.S. Cl. ..... 361/220; 361/222; 361/230

[58] Field of Search ..... 361/213, 220, 222, 230

[56] References Cited

U.S. PATENT DOCUMENTS

| | | | |
|---|---|---|---|
| 2,866,923 | 12/1958 | Herbert, Jr. | 361/230 |
| 3,137,806 | 6/1964 | Schweriner | 361/230 |
| 3,443,155 | 5/1969 | Schweriner | 361/230 |
| 3,697,806 | 10/1972 | Herbert, Jr. | 361/230 |
| 3,725,736 | 4/1973 | Bishop | 361/230 |
| 3,887,843 | 6/1975 | Richardson et al. | 361/222 |
| 3,968,405 | 7/1976 | Testone | 361/220 |
| 4,016,455 | 4/1977 | Christiansen | 361/222 |

*Primary Examiner*—Gerald Goldberg
*Attorney, Agent, or Firm*—Bauer, Amer & King

[57] ABSTRACT

A static eliminator having an electrical cable for providing a corona field that is discharged by capacitors each having a body and an emitter electrode formed indivisible and as unitary parts of each other and wherein the housing of such eliminator cooperates with the capacitor structures so as to enable them to be quickly and easily assembled in such manner that if, and when, it is desired to vary the discharge at the electrodes, the same may be accomplished by the use of a metallic sleeve or band cooperating with the cable and capacitor.

17 Claims, 6 Drawing Figures

STATIC ELIMINATOR AND ION DISCHARGE MEANS THEREFOR

BACKGROUND OF THE INVENTION

The present invention relates to static eliminators and more particularly to a static eliminator in which the emitter electrodes are formed as an integral part of the capacitor elements.

DESCRIPTION OF THE PRIOR ART

In the past, in such devices as illustrated in U.S. Pat. No. 3,037,149 to William C. Herbert, Jr., a plurality of metallic capacitor sleeves were positioned upon an electrical cable about which a corona discharge was produced. The corona discharge accumulated in the capacitor sleeves, and this discharge was then pointedly discharged through emitter electrode pins that were pressed into electrical engagement with the capacitor sleeves. The capacitor sleeves were insulated and spaced from each other by dielectric spacers. The length of the capacitor elements and the nature of the engagement of the emitter pins with such elements controlled the extent of the static discharge.

Problems in manufacturing the aforesaid type of static eliminators were apparent. One could not be certain that the eliminator pins were in perfect electrical discharge contact with their respective capacitor sleeves. Moreover, the extent of such contact between the pins and the capacitors varied and sometimes was completely interrupted by changes in temperature to which the static eliminator might be subjected. Vibration to which the static eliminator is subjected also results in an interference with the electrical interface and connection between the emitter pins and their respective capacitor sleeves.

Problems in manufacture were also evident. It was necessary to assure that each emitter pin was so positioned as to be retained in perfect electrical engagement with its respective capacitor. The alignment of the pins with their capacitors in an overall elongated static eliminator and the manner in which the pins were mounted became a problem.

Attention is directed to U.S. Pat. No. 2,866,923 of William C. Herbert, Jr., which teaches the use of coil type capacitive elements. However, such capacitive elements suffered from the same problems as previously described in the prior art since the emitter electrodes were formed separately from the capacitor coils and, therefore, the electrical interface between the emitter electrodes and the capacitor elements required careful assembly, inspection and quality control because the same were subject to the vagaries of weather, temperature, vibration and improper assembly.

OBJECTS OF THE INVENTION

The desideratum of the invention is to eliminate and overcome the aforedescribed prior art problems to result in a more readily manufactured and easily, positively assembled static eliminator in which the capacitors and the emitter pins or electrodes are formed inseparable and unitary with each other so there can never be any interruption of electrical contact between the emitter pins and their respective capacitors.

An object of the present invention is to provide a static eliminator which has a plurality of electron discharge means comprised of capacitor elements and emitter electrodes that are positive in operation and unaffected by misassembly, vibration, temperature or other conditions acting thereupon.

Another object of the present invention is to provide a capacitive discharge member that may be used in a static eliminator wherein the same has a wound or coiled body and an inseparable emitter pin forming the termination of the coiled body at each end thereof.

A further object of the present invention is to provide a variable capacitive discharge structure for use in a static eliminator by using a tubular metallic sleeve or painted band or foil extending axially through and for a predetermined extent beyond each of the aforementioned capacitive discharge members to increase the charging area thereof.

Still another object and feature of the invention is to provide a simple yet unique static eliminator in which the capacitor electron discharge members and housing for supporting the same cooperate to result in a simple combination of structure that enables their ready and easy assembly without the need for unusual skills or tools.

Other objects and advantages of the present invention will become apparent as the disclosure proceeds.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

Referring now to FIGS. 1, 2 and 3 of the drawing, the static eliminator there shown is generally identified by the numeral 10 and comprises a housing that is generally identified by the numeral 12. The housing 12 is elongated in a longitudinal direction and comprises at least two dielectric or insulating housing parts 14 and 16 each of which extends at least substantially the full length of the housing 12.

Figure 1:
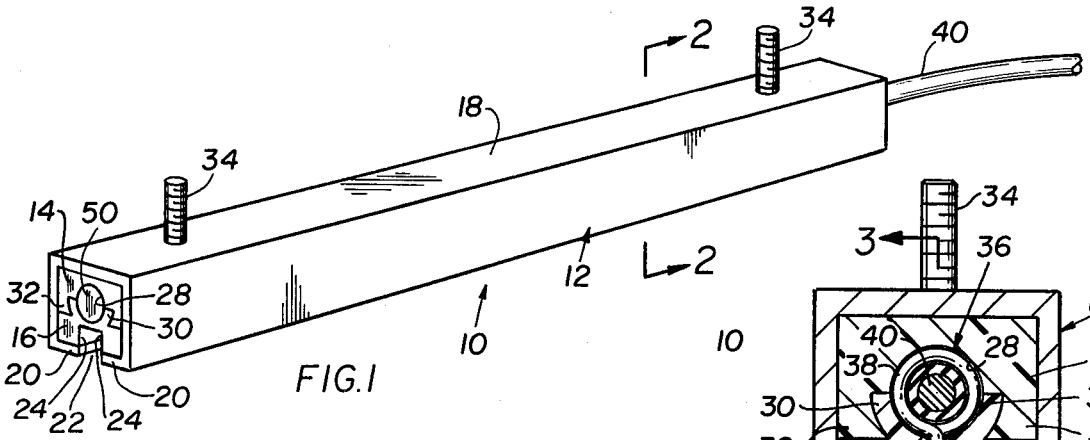
FIG. 1 is a perspective view of a static eliminator constructed according to the teaching of the invention.
Figure 2:
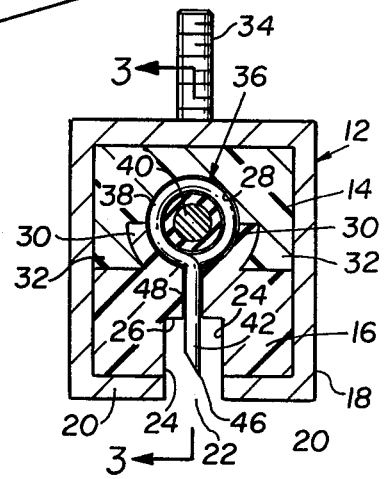
FIG. 2 is a cross section of FIG. 1 taken along the lines 2—2 of FIG. 1.

The housing parts 14 and 16 are retained in assembled relationship by, among other details, a metallic shield 18 that extends for substantially the full length of the housing 12 and in surrounding relationship with the two housing parts as illustrated in FIGS. 1 and 2 of the drawing. The shield 18 extends about the top, the sides and the emitting portion of the housing at the in-turned legs 20 as shown in FIGS. 1 and 2. The legs 20 are relatively spaced from each other to provide an opening or channel-shaped slot 22 through which electrons are intended to be emitted in a directed array and stream in a manner to be described.

The slot 22 extends for substantially the full length of the housing 12 and its continuation is defined within the housing part 16 by the side walls 24 that terminate and merge with the base wall 26, all of which provide the U-shaped channel or slot 22 which extends, as illustrated in FIG. 1, from one end of the housing 12 to the other.

The housing parts 14 and 16, being made of insulative or dielectric material, form a complete dielectric housing in which there is provided an elongated interior chamber or cavity 28 that extends for the full length of the housing 12. The chamber or cavity 28 is defined in two parts by a complementary arrangement of interlocking and interengaging structures provided on both the housing parts 14 and 16. Thus, for convenience of understanding and ease of description, the interlocking parts are illustrated more clearly in FIGS. 1 and 2 by the upwardly turned curved elements forming a semicircular part of the cavity 28 and taking the shape of fingers 30 that are formed integral with the housing part 16.

The conformingly shaped engaging and encompassing fingers 32 that extend down and about the fingers 30 each cooperate with the other to retain the two parts 14 and 16 in engaged relationship and to define the circular interior chamber or cavity 28. In so doing, the engaging elements of the two parts 14 and 16 define a completely enclosed dielectric covering for the cavity 28 to retain therein electrons that may accumulate in such chamber and to prevent the discharge of electrons beyond the housing except from electron discharge means in a manner to be described.

Those skilled in the art will readily recognize that by reason of the elongate construction of the housing parts 14 and 16, the same may be formed as continuous extruded plastic members which may be cut off in any desired length to produce the exact length of the required housing 12. The enclosure of the shield 18 about the two housing parts further prevents the passage of stray electrons from beyond the static eliminator 10 except by way of and through the channel 22 in a manner and for a purpose that will be described. The shield 18 being of a metallic material is provided with mounting posts or threaded supports 34 which extend therefrom in any desired manner for grounding and discharge of electrons from the electron discharge means to the shield. In the illustration of the drawings, the posts 34 extend upwardly to enable the static eliminator 10 to be ground mounted on any convenient surface or support of a machine or other apparatus where the static eliminator 10 is required for use.

Figure 3:
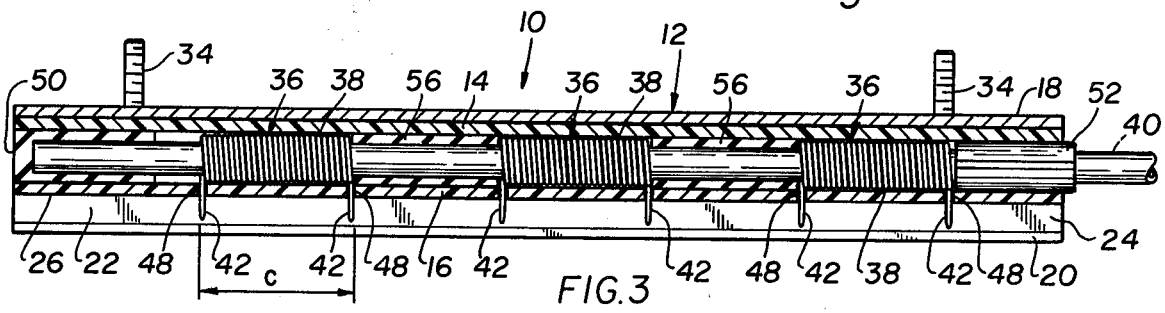
FIG. 3 is a vertical sectional view of the static eliminator taken along lines 3—3 of FIG. 2.
Figure 5:
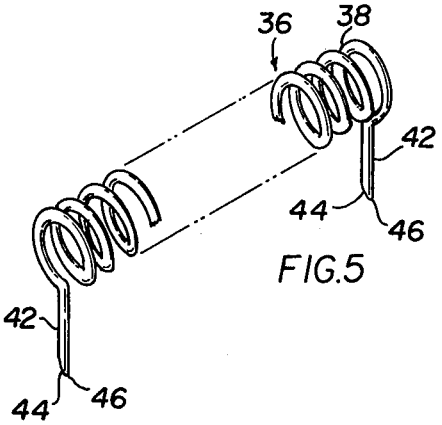
FIG. 5 is an expanded view of an embodiment of the unique electron discharge means according to the invention.

Mounted within the cavity 28 are a plurality of ion discharge members or means generally identified by the numeral 36. The electron discharge means 36 constitutes a unique and novel arrangement of structure as disclosed in the present invention. As the same are illustrated in FIGS. 3 and 5, the electron discharge means 36 comprises a body 38 that is sleeve shaped in configuration. That is to say, the body is provided with an interior opening or passageway in which an insulated electrical cable 40 is adapted to be mounted and through which the same is to extend. The electron discharge means is illustrated in expanded view in FIG. 5 to more clearly enable a description and an understanding as well as a recognition of the detailed parts thereof.

Thus, in the manufacture of the electron discharge member 36, a conductive wire element may be wrapped helically about a member of any desired configuration to assume the desired configuration with the desired interior sleeve-shape. The wire element is shaped in the form of a helix coil thereby producing the sleeve-shaped body 38 which may be of any desired length as dictated by the number of turns of wire. The body 38 functions in the nature of a capacitor which is adapted to accumulate electrons produced by the corona field of the cable 40.

When the capacity of the body 38 is reached, the accumulated electrons are discharged therefrom exterior of the housing 12 at the slot 22. The discharging electrons may be controlled in their array and in their direction of flow. This is accomplished by providing each of the electron discharge members 36 with one or more electron emitter pins 42 that are formed as unitary, integral terminations of the ends of the capacitor body 38 and continuous electrical uninterrupted extensions thereof. It will be recognized that the emitter pins 42 are indivisible from the capacitor body and, therefore, are inseparable, unitary, integral and unbroken parts thereof. As a consequence, no matter what forces may be applied to the electron discharge means 36, the same will not affect the relationship of the emitter pins 42 in their function of discharging electrons from the body 38. The pins 42 are conveniently bent from the opposite ends of the coiled body 38 to extend in the same radial direction, for the same lengths and in alignment with each other.

To accomplish the pinpointing emission of electrons from the capacitive bodies 38, the pins may be tapered as at 44 to a point 46 as is more clearly illustrated in FIG. 5. Although the pins have been shown to be tapered to the points 46, this arrangement of structural details is not necessary. However, in practice, it has been found that the pinpointing of the emitter pins 42 enables a more exact emission of electrons in a desired spray form. It is within the scope of the invention that the pins need not be pinpointed as shown and described, but rather may take any other desired end configuration.

The present arrangement of structural details is so unique and simple as to materially reduce the cost of manufacture and the ease of assembly even by relatively unskilled personnel. Assembly may be accomplished in the following manner. The housing part 16 is provided with a plurality of apertures 48 that are previously drilled therein at predeterminately spaced locations along the length of the portion of the cavity 28 as defined by the fingers 30 of the part 16 of the housing. The apertures 48 are drilled in a straight line. Therefore, when the housing part 16 is placed on a flat surface, it is merely necessary for an unskilled worker to take a number of electron discharge members 36 and place the pins 42 thereof into the predeterminately spaced drilled apertures 48 much in the manner as is illustrated in FIG. 3.

By positioning the pins 42 within their respective apertures 48, the body 38 connected thereto is automatically retained and positioned within the conforming arcuate shape and configuration as defined by the interior of the interlocking fingers 30. In this way, the bodies 38 of each discharge means 36 are seated precisely in the desired position, snuggled within the conforming contour of the fingers 30 and thereby prevented from accidental displacement therefrom by the locating pins 42 positioned within their respective apertures 48.

In the illustration of FIG. 3, there is shown three electron discharge members 36. Those skilled in the art will readily recognize that the illustration of three electron discharge members is not to constitute a limitation upon the scope of the invention. The number thus illustrated is for explanation purposes only to enable a clearer understanding of the invention. Any number of electron discharge members 36 can be utilized in a static eliminator 10 depending upon the length of such static eliminator and the function required to be performed thereby.

When all of the electron discharge means 36 are properly mounted in position in the lower part of the cavity 28 of the housing part 16, the upper part 14 of the housing is moved relative to the lower part 16 by causing the two fingers 32 to engage about the curved fingers 30. The relative sliding engagement of the two parts 14 and 16 now produces a completed dielectric housing in which the capacitive electron discharge means 36 are enclosed. The cable 40 is then inserted into the automatically aligned sleeves or hollow interiors of each of the bodies 38. The insertion of the cable through each of the hollow bodies 38 is accomplished quickly and easily because each of the bodies are retained fixedly in their predetermined aligned relationship within the cavity.

When the cable 40 is inserted through all of the bodies, an end closure dielectric insulating cap 50 is then positioned over the left hand end of the cable 40 as illustrated in FIG. 3. The cap 50 thus encloses the free end of the cable to insulate the same from engagement with any metallic surface or from shock hazard with any individual or person who may accidentally come in contact with the same. The right hand end of the housing may then be closed by an end closure insulating member 52 in the form of a C-shaped washer or any other dielectric plug that will adequately electrically seal closed the space between the cable 40 and the enclosing surfaces of the cavity formed by the two parts 14 and 16.

In practice, it has been found convenient to seal the parts 14 and 16 to each other by a bonding material that will more adequately assure a complete electrical enclosure. However, the same is unnecessary since the tortuous path provided by the interlocking fingers 30 and 32 prevents the passage of stray electrons outward from the interior cavity 28. The completed housing is facilitated by the application of the shield 18 thereabout that is grounded at the mounting posts 34.

In the operation of the device, the static eliminator 10 is mounted to a convenient surface at its posts 34 and a current is applied to the cable 40. A corona discharge is created about the cable 40 which causes a flow of electrons that are accumulated by the capacitive bodies 38 which, when they reach their capacitance, discharge the electrons at their emitter pins 42 that project beyond the exterior of the housing surface 26. The discharged electrons flow outward from the pins within the slot 22 in a predetermined path toward the grounded walls defined by the legs 20. The shape of the path or flow of electrons from the emitter pins 42 to the walls 20 may be varied by varying the end shape of the emitter pins and/or by varying the relative spacing of the legs 20 from such emitter pins.

It is interesting to note that in the construction of the present invention, the members 36 are retained in relatively spaced relationship longitudinally along the length of the cavity 28 by reason of their initial positioning of the emitter pins 42 within the apertures 48 predeterminately provided within the cavity. Thus, the relative spacing of the members 36 can be varied predeterminately prior to the assembly of the static eliminator device 10. No spacers are required to be inserted between the bodies 38 of each of the electron discharge members 36 for the purpose of retaining their spaced relationship, although they may be used as shown at 56. Hence, the present construction eliminates the need of such spacers and provides for an easily assembled reliably constructed device.

Figure 4:
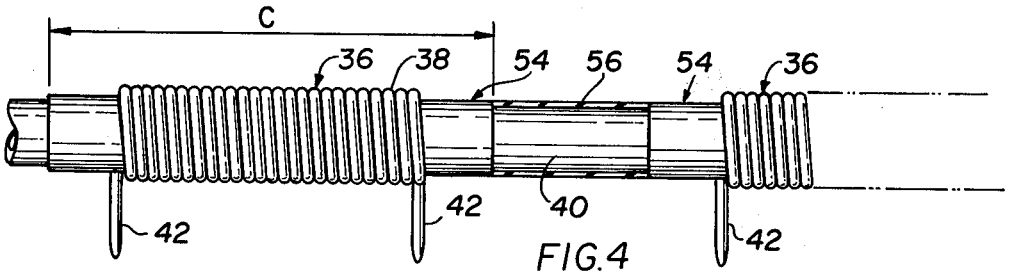
FIG. 4 is a fragmentary enlarged view illustrating another embodiment for the construction of the static eliminator illustrated in FIG. 1.

When for any reason it is desired to increase or vary the capacitance of the electron discharge means 36 without, however, changing the length of their respective bodies 38, this is accomplished easily and readily in the present invention by the construction illustrated in FIG. 4. In the construction of FIG. 4, the metallic capacitor in the form of a sleeve, a painted band, a foil or the like 54 is preselected. The length of the member 54 may be predetermined in accordance with the capacitance requirements of the electron discharge means 36. That is to say, if it is desired to produce a greater discharge of electrons than that capable of being accumulated by the capacitor bodies 38 of the electron discharge means 36 illustrated in FIG. 4, the metallic member 54 is selected in accordance with the end needs.

The member 54 is positioned in the interior or hollow of the sleeve shaped body 38 as shown in FIG. 4 and positioned about the corona discharge cable 40, also as shown in FIG. 4. The increased length of the capacitive member 54 will accumulate a charge from the cable and impart or transmit the same by conduction to the body 38 of the electron discharge means 36 where the charge is discharged by way of the emitter pins 42 there shown. Thus, it will be seen that there is no reason to vary the number of windings of the coil shaped body 38. All that is necessary is to interposition between the electrical cable 40 and the body 38 of each electron discharge means 36 the capacitor member 54 of the desired length and material. If desired, the same may comprise a band of foil that is affixed to the cable 40 or painted thereabout. Hence, the sleeve 54 shown in FIG. 4 is for illustration purposes only.

In this arrangement of structure, the tension force of the coils 38 about the separate sleeve 54 is sufficient to retain the sleeve 54 in its desired position about the cable 50, especially since the means 36 is prevented from axial or lengthwise movement within the cavity 28 by reason of the engagement of its emitter pins 42 in the apertures 48. However, to prevent possible accidental displacement of the longer capacitor sleeves 54 from within their electron discharge means 38, a spacer sleeve 56 may be inserted between adjacent sleeves 54.

Figure 6:
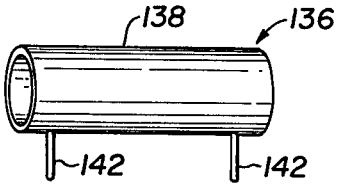
FIG. 6 is a perspective view of another embodiment of the discharge means.

In the embodiment shown in FIG. 6, the discharge means 136 there shown may assume the shape of an elongated metallic hollow sleeve shaped body 138 that is open at its opposite ends in the same manner and for the same purpose as the aforedescribed body 38. One or more emitter discharge pins 142 may be welded or otherwise inseparably affixed to the body 138 to extend radially therefrom at strategic or predetermined positions therealong to become integral therewith and to form a unitary inseparable, unbroken electrical continuous extension thereof in the same manner as the pins 42. The number of pins 142 and their permanent positioning to the body 138 may be predetermined to produce a desired field and array of discharged electrons. The capacity of the member 136 may be increased by the use of an additional capacitor sleeve, band or painted foil 54 in the same manner as described previously, while the shape of the distal end of the pins 142 also may be varied as required.

From what has been described, it will be clear that the present invention teaches the use of a static eliminator in which the electron discharge means are of a unique construction, in which the emitter pins or electrodes extend unbroken from their bodies through the positioning apertures provided within the enclosing dielectric housing. The unique arrangement of details of the electron discharge means enables a variation of the discharge function of such means by including within the device a metallic sleeve that enables the electron discharge means to increase or vary its capacitance and its discharge. The housing is so arranged in details as to avoid any possibility of misassembly and also of interruption of electron flow from the capacitor body to the emitter electrodes or pins, since the emitter electrodes or pins are formed as an integral unitary and inseparable part of the electron discharge means.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a static eliminator, an insulator housing having a plurality of interengaging dielectric parts one of which has an interior cavity and longitudinally spaced apart apertures extending from said cavity to the exterior of said housing, a plurality of electron discharge means in said housing cavity, each said discharge means having a capacitor body and emitter pin inseparably formed as a unit with each said emitter pin being positioned snugly within a respective one of said apertures against movement relative to each other and their respective apertures and extending to the exterior of said one housing part such that each of said discharge means is longitudinally spaced from the other in said housing cavity, the other of said housing parts closing said cavity and enclosing said discharge means therein, and an insulated conductor extending longitudinally into said housing through each of said capacitor bodies.

2. In a static eliminator as in claim 1, each said capacitor body being coiled with an end thereof terminating in said unitary emitter pin.

3. In a static eliminator as in claim 1, each said capacitor body having an emitter pin permanently extending radially therefrom in unbroken and inseparable electrical continuity therewith.

4. In a static eliminator as in claim 1, and metallic means interposed between each said discharge means and said insulated conductor for increasing the charging area of each said discharge means.

5. In a static eliminator, an elongated insulator housing comprising a plurality of complementary insulator housing members each cooperatively engageable with the other to enable the same to be moved relative to each other in one direction and to restrain the same against relative separation from each other in another direction, said insulator housing members having a cavity defined therein and extending along the length thereof, an electrical cable projecting into said housing from one end thereof, a plurality of unitary discharge means each including a capacitor body and at least an emitter electrode inseparably formed therewith, each of said discharge means being relatively spaced in said cavity and said electrodes extending outward therefrom, said housing having apertures defined therein through which said emitter electrodes extend outward from said housing and in which said emitter electrodes are retained to retain their respective capacitor bodies in relative spaced relationship in said cavity and against movement relative to each other and said cavity with each said capacitor body being aligned with the other along the length of said cavity for the ready insertion of said electrical cable through said aligned capacitor bodies, and said emitter electrodes being longer than said apertures to extend unbroken from said cavity to the exterior of said housing.

6. In a static eliminator as in claim 5, said capacitor body being formed of a plurality of wound coils with unitary terminating ends thereof defining said emitter electrodes.

7. In a static eliminator as in claim 5, said capacitor body being a metallic sleeve, and an emitter electrode permanently affixed thereto as a unitary, unbroken continuous electrical extension thereof.

8. In a static eliminator as in claim 5, and metallic means interposed between each said capacitor body and said electrical cable and extending beyond the ends of said capacitor body for increasing the capacity of said discharge means.

9. In a static eliminator as in claim 8, said capacitor body having a plurality of wound coils in which the terminating ends thereof are formed unitary therewith and define said emitter electrodes.

10. In a static eliminator as in claim 8 said capacitor body being of a sleeve-shaped metallic material, and at least a plurality of emitter electrodes inseparably affixed to said body as a unitary part thereof to form uninterrupted and continuous electrical extensions thereof.

11. A capacitive discharge member for use in a static eliminator having an insulated conductor extending thereinto comprising a body portion having an axially extending inner passage for encircling the insulated conductor when mounted in the static eliminator, emitter pin means unitary and inseparably formed with said body portion and extending radially therefrom, and a metallic means in said inner passage of said body portion and extending therebeyond said body portion at each end thereof so as to increase the charging area of the capacitive discharge member.

12. A capacitive discharge member as in claim 11, wherein said body portion is formed from wire helically wound, and said emitter pin means being formed as unitary extensions of the first and last turns of said body portion.

13. A capacitive discharge member as in claim 11, wherein each said emitter pin is pointed at the distal end thereof.

14. A capacitive discharge member as in claim 11, wherein said body is of sleeve-shaped metallic material and said emitter pin means are affixed thereto at predetermined positions therealong to form uninterrupted electrical extensions thereof.

15. A static eliminator comprising an elongated dielectric housing having a cavity extending longitudinally therein, a plurality of electron discharge means relatively spaced from each other in said cavity, said housing being formed by a plurality of dielectric parts each of which cooperates with the other to define said cavity, said parts being relatively movable and engageable with each other to dielectrically enclose said discharge means in said cavity, apertures in said housing through which said discharge means extend to emit a discharge of electrons beyond said cavity and housing and to snugly retain said discharge means in longitudinal alignment and against movement relative to each other and to said housing, and an insulated electrical cable extending longitudinally into said housing and cooperating with said aligned discharge means to cause said discharge means to accumulate and discharge electrons.

16. A static eliminator as in claim 15 each said discharge means having a sleeve-shaped body terminating in emitter pins formed unitary therewith and extending unbroken through said apertures such that the sleeves of said plurality of discharge means are in alignment with each other in said housing cavity and said cable extends through each of said aligned sleeves.

17. A static eliminator as in claim 15, said plurality of housing parts each having interlocking engaging means to insulate said cavity from the stray passage of electrons from said cavity and to inhibit the accidental displacement and disengagement of one of said parts from the other.

* * * * *